US009173797B2

(12) United States Patent
Andrienko

(10) Patent No.: US 9,173,797 B2
(45) **Date of Patent: *Nov. 3, 2015**

(54) SIDERAIL ASSEMBLY FOR PATIENT SUPPORT APPARATUS

(71) Applicant: Hill-Rom Services, Inc., Batesville, IN (US)

(72) Inventor: Kirill Andrienko, Harrison, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/146,280

(22) Filed: Jan. 2, 2014

(65) Prior Publication Data

US 2014/0109317 A1 Apr. 24, 2014

Related U.S. Application Data

(63) Continuation of application No. 12/965,953, filed on Dec. 13, 2010, now Pat. No. 8,621,688.

(51) Int. Cl.

| | |
|---|---|
| ***A61G 7/053*** | (2006.01) |
| ***A61G 7/16*** | (2006.01) |
| ***A61G 7/015*** | (2006.01) |
| ***A47C 21/08*** | (2006.01) |
| *A61G 7/05* | (2006.01) |

(52) U.S. Cl.

CPC ..... *A61G 7/053* (2013.01); *A47C 21/08* (2013.01); *A61G 7/015* (2013.01); *A61G 7/16* (2013.01); *A61G 2007/051* (2013.01); *A61G 2007/0513* (2013.01); *A61G 2203/16* (2013.01); *A61G 2203/40* (2013.01)

(58) Field of Classification Search

CPC ..... A61G 2007/0508; A61G 2007/0509; A61G 2007/051; A61G 7/0507; A47C 21/08

USPC ..... 5/424–430, 618

See application file for complete search history.

(56) References Cited

U.S. PATENT DOCUMENTS

| | | | |
|---|---|---|---|
| 421,656 | A | 2/1890 | Blanken |
| 1,279,120 | A | 9/1918 | Kellogg |
| 1,778,698 | A | 10/1930 | Walter |
| 2,585,660 | A | 2/1952 | Kjos et al. |
| 2,722,017 | A | 11/1955 | Burst et al. |
| 2,817,854 | A | 12/1957 | Pratt |
| 2,817,855 | A | 12/1957 | Pratt |
| 3,021,534 | A | 2/1962 | Hausted |

(Continued)

FOREIGN PATENT DOCUMENTS

| | | |
|---|---|---|
| EP | 1 693 037 A1 | 8/2006 |
| EP | 1816994 | 8/2007 |

(Continued)

OTHER PUBLICATIONS

English Abstract for DE 102006011852 (B3), 1 page, Jun. 6, 2007.

*Primary Examiner* — David E Sosnowski
*Assistant Examiner* — Eric Kurilla
(74) *Attorney, Agent, or Firm* — Barnes & Thornburg LLP

(57) ABSTRACT

A siderail assembly includes a guide, a support coupled to the guide to move relative to the guide, and a barrier coupled to the guide. The barrier is movable between a lowered position, wherein the barrier is situated substantially below a frame of a patient support apparatus, and a raised position, wherein the barrier is situated substantially above the frame.

16 Claims, 8 Drawing Sheets

(56) References Cited

U.S. PATENT DOCUMENTS

| | | | |
|---|---|---|---|
| 3,055,020 | A | 9/1962 | Mann |
| 3,100,129 | A | 8/1963 | Adolphson |
| 3,179,957 | A | 4/1965 | Norton |
| 3,220,024 | A | 11/1965 | Nelson |
| 3,249,387 | A | 5/1966 | Pivacek |
| 3,286,283 | A | 11/1966 | Bertoldo |
| 3,312,986 | A | 4/1967 | Fahrni et al. |
| 3,318,596 | A | 5/1967 | Herzog |
| 3,344,445 | A | 10/1967 | Crawford |
| 3,351,962 | A | 11/1967 | Dodrill et al. |
| 3,486,176 | A | 12/1969 | Murcott |
| 3,585,659 | A | 6/1971 | Burst et al. |
| 3,747,133 | A | 7/1973 | Hutt |
| 3,865,434 | A | 2/1975 | Sully |
| 3,932,903 | A | 1/1976 | Adams et al. |
| 3,971,083 | A | 7/1976 | Peterson |
| 4,002,330 | A | 1/1977 | Johansson |
| 4,105,242 | A | 8/1978 | Terbeek |
| 4,119,342 | A | 10/1978 | Jones |
| 4,120,530 | A | 10/1978 | Imbro |
| 4,221,370 | A | 9/1980 | Redwine |
| 4,277,100 | A | 7/1981 | Beougher |
| 4,417,361 | A | 11/1983 | Smith |
| 4,439,880 | A | 4/1984 | Koncelik et al. |
| 4,541,622 | A | 9/1985 | Tabuchi |
| 4,612,679 | A | 9/1986 | Mitchell |
| 4,626,016 | A | 12/1986 | Bergsten |
| 4,632,450 | A | 12/1986 | Holdt |
| 4,680,790 | A | 7/1987 | Packard et al. |
| 4,691,962 | A | 9/1987 | Holdt |
| 4,703,975 | A | 11/1987 | Roberts et al. |
| 4,715,592 | A | 12/1987 | Lewis |
| 4,747,171 | A | 5/1988 | Einsele et al. |
| 4,795,214 | A | 1/1989 | Holdt |
| 4,839,933 | A | 6/1989 | Plewright et al. |
| 4,932,090 | A | 6/1990 | Johansson |
| 4,959,878 | A | 10/1990 | Essek |
| 4,993,089 | A | 2/1991 | Solomon et al. |
| 5,038,430 | A | 8/1991 | Bly |
| 5,060,327 | A | 10/1991 | Celestina et al. |
| 5,069,465 | A | 12/1991 | Stryker et al. |
| 5,083,430 | A | 1/1992 | Hirata et al. |
| 5,084,925 | A | 2/1992 | Cook |
| 5,195,200 | A | 3/1993 | Leoutsakos |
| D336,578 | S | 6/1993 | Celestina |
| 5,216,768 | A | 6/1993 | Bodine et al. |
| 5,225,403 | A | 7/1993 | Treiber et al. |
| 5,231,721 | A | 8/1993 | Fish |
| 5,255,403 | A | 10/1993 | Ortiz |
| 5,333,887 | A | 8/1994 | Luther |
| 5,335,385 | A | 8/1994 | Brown |
| 5,337,430 | A | 8/1994 | Schlein |
| 5,347,682 | A | 9/1994 | Edgerton, Jr. |
| 5,381,571 | A | 1/1995 | Gabhart |
| 5,384,927 | A | 1/1995 | Mardero et al. |
| 5,388,294 | A | 2/1995 | Reeder |
| 5,394,581 | A | 3/1995 | Leoutsakos |
| 5,418,988 | A | 5/1995 | Iura |
| 5,433,235 | A | 7/1995 | Miric et al. |
| 5,463,784 | A | 11/1995 | Alpern |
| 5,471,689 | A | 12/1995 | Shaw et al. |
| 5,485,699 | A | 1/1996 | Gabhart |
| 5,542,136 | A | 8/1996 | Tappel |
| 5,542,138 | A | 8/1996 | Williams et al. |
| 5,586,352 | A | 12/1996 | O'Brien et al. |
| 5,659,910 | A | 8/1997 | Weiss |
| 5,678,267 | A | 10/1997 | Kinder |
| 5,680,661 | A | 10/1997 | Foster et al. |
| 5,689,839 | A | 11/1997 | Laganiere et al. |
| 5,715,548 | A | 2/1998 | Weismiller et al. |
| 5,781,945 | A | 7/1998 | Scherer et al. |
| 5,787,530 | A | 8/1998 | Brix |
| 5,802,636 | A | 9/1998 | Corbin et al. |
| 5,806,111 | A | 9/1998 | Heimbrock et al. |
| 5,832,549 | A | 11/1998 | Le Pallec et al. |
| 5,836,026 | A | 11/1998 | Reed |
| 5,842,237 | A | 12/1998 | Hargest et al. |
| 5,878,452 | A | 3/1999 | Brooke et al. |
| 6,009,570 | A | 1/2000 | Hargest et al. |
| 6,021,533 | A | 2/2000 | Ellis et al. |
| 6,058,531 | A | 5/2000 | Carroll |
| 6,076,209 | A | 6/2000 | Paul |
| 6,089,593 | A | 7/2000 | Hanson et al. |
| 6,101,678 | A | 8/2000 | Malloy et al. |
| 6,154,899 | A | 12/2000 | Brooke et al. |
| 6,163,903 | A | 12/2000 | Weismiller et al. |
| 6,182,310 | B1 | 2/2001 | Weismiller et al. |
| 6,185,767 | B1 | 2/2001 | Brooke et al. |
| 6,185,769 | B1 | 2/2001 | Larisey, Jr. et al. |
| 6,212,714 | B1 | 4/2001 | Allen et al. |
| 6,240,583 | B1 | 6/2001 | Brooke et al. |
| 6,289,537 | B1 | 9/2001 | Hopper et al. |
| 6,315,319 | B1 | 11/2001 | Hanson et al. |
| 6,336,235 | B1 | 1/2002 | Ruehl |
| 6,374,436 | B1 | 4/2002 | Foster et al. |
| D458,481 | S | 6/2002 | Brooke |
| D459,119 | S | 6/2002 | Brooke |
| 6,397,416 | B2 | 6/2002 | Brooke et al. |
| 6,427,264 | B1 | 8/2002 | Metz et al. |
| 6,446,287 | B2 | 9/2002 | Borders |
| 6,486,792 | B1 | 11/2002 | Moster et al. |
| 6,496,993 | B2 | 12/2002 | Allen et al. |
| 6,565,112 | B2 | 5/2003 | Hanson et al. |
| 6,668,402 | B2 | 12/2003 | Heimbrock |
| 6,675,418 | B1 | 1/2004 | Armstrong |
| 6,684,427 | B2 | 2/2004 | Allen et al. |
| 6,691,350 | B2 | 2/2004 | Weismiller |
| 6,694,548 | B2 | 2/2004 | Foster et al. |
| 6,704,954 | B2 | 3/2004 | Metz et al. |
| 6,725,474 | B2 | 4/2004 | Foster et al. |
| 6,726,279 | B1 | 4/2004 | Figel et al. |
| 6,728,985 | B2 | 5/2004 | Brooke et al. |
| 6,789,280 | B1 | 9/2004 | Paul |
| 6,817,363 | B2 | 11/2004 | Biondo et al. |
| 6,820,293 | B2 | 11/2004 | Alverson |
| 6,829,793 | B2 | 12/2004 | Brooke et al. |
| 6,846,042 | B2 | 1/2005 | Hanson et al. |
| 6,860,281 | B1 | 3/2005 | Clift |
| 6,874,179 | B2 | 4/2005 | Hensley et al. |
| 6,948,202 | B2 | 9/2005 | Weismiller |
| 6,961,972 | B2 | 11/2005 | Pendell |
| 6,978,499 | B2 | 12/2005 | Gallant et al. |
| 7,000,272 | B2 | 2/2006 | Allen et al. |
| 7,017,208 | B2 | 3/2006 | Weismiller et al. |
| 7,020,920 | B2 | 4/2006 | Armstrong |
| 7,028,354 | B2 | 4/2006 | Nygren et al. |
| 7,032,265 | B2 | 4/2006 | Miller |
| 7,039,971 | B2 | 5/2006 | Sebastien |
| 7,073,220 | B2 | 7/2006 | Simmonds et al. |
| 7,076,818 | B2 | 7/2006 | Kummer et al. |
| 7,107,636 | B2 | 9/2006 | Metz et al. |
| 7,150,058 | B2 | 12/2006 | Rabska et al. |
| D535,544 | S | 1/2007 | DeBraal et al. |
| 7,171,709 | B2 | 2/2007 | Weismiller |
| 7,200,882 | B2 | 4/2007 | Heimbrock |
| 7,213,279 | B2 | 5/2007 | Weismiller et al. |
| 7,216,384 | B2 | 5/2007 | Allen et al. |
| 7,234,182 | B2 | 6/2007 | Miller et al. |
| 7,237,287 | B2 | 7/2007 | Weismiller et al. |
| 7,243,386 | B2 | 7/2007 | Gallant et al. |
| 7,325,265 | B2 | 2/2008 | Hornbach et al. |
| 7,343,916 | B2 | 3/2008 | Biondo et al. |
| 7,350,248 | B2 | 4/2008 | Hensley et al. |
| 7,406,729 | B2 | 8/2008 | Hornbach et al. |
| 7,430,771 | B2 | 10/2008 | Heimbrock |
| 7,452,032 | B1 | 11/2008 | Roleder et al. |
| 7,454,805 | B2 * | 11/2008 | Osborne et al. ..... 5/618 |
| 7,458,119 | B2 | 12/2008 | Hornbach et al. |
| 7,472,445 | B2 | 1/2009 | Miller |
| 7,480,951 | B2 | 1/2009 | Weismiller et al. |
| 7,512,998 | B2 | 4/2009 | Martin et al. |
| 7,523,515 | B2 | 4/2009 | Allen et al. |
| 7,536,738 | B2 | 5/2009 | Richards et al. |
| 7,568,246 | B2 | 8/2009 | Weismiller et al. |

(56) References Cited

U.S. PATENT DOCUMENTS

| | | | |
|---|---|---|---|
| 7,568,249 | B1 | 8/2009 | Kunde et al. |
| 7,600,817 | B2 | 10/2009 | Kramer et al. |
| 7,636,966 | B2 | 12/2009 | Gallant et al. |
| 7,665,166 | B2 | 2/2010 | Martin et al. |
| 7,676,862 | B2 | 3/2010 | Poulos et al. |
| 7,690,059 | B2 | 4/2010 | Lemire et al. |
| 7,703,158 | B2 | 4/2010 | Wilker, Jr. et al. |
| 7,730,562 | B2 | 6/2010 | Hornbach et al. |
| 7,743,441 | B2 | 6/2010 | Poulos et al. |
| 7,757,318 | B2 | 7/2010 | Poulos et al. |
| 7,774,873 | B2 | 8/2010 | Martin et al. |
| 7,779,493 | B2 | 8/2010 | Lemire et al. |
| 7,779,494 | B2 | 8/2010 | Poulos et al. |
| 7,784,128 | B2 | 8/2010 | Kramer |
| 7,788,748 | B2 | 9/2010 | Wurdeman |
| 7,805,784 | B2 | 10/2010 | Lemire et al. |
| 7,805,789 | B1 | 10/2010 | Dean |
| 7,861,334 | B2 | 1/2011 | Lemire et al. |
| 8,322,342 | B2 | 12/2012 | Soto et al. |
| 8,621,688 | B2 | 1/2014 | Andrienko |
| 2001/0027578 | A1 | 10/2001 | Brooke et al. |
| 2002/0002742 | A1 | 1/2002 | Osborne et al. |
| 2002/0095728 | A1 | 7/2002 | Weismiller |
| 2003/0024048 | A1 | 2/2003 | Heimbrock |
| 2003/0056293 | A1 | 3/2003 | Brooke et al. |
| 2003/0167568 | A1 | 9/2003 | Brooke |
| 2004/0168254 | A1 | 9/2004 | Rabska et al. |
| 2005/0015879 | A1 | 1/2005 | Cuschieri et al. |
| 2005/0120485 | A1 | 6/2005 | Sebastien |
| 2006/0085914 | A1 | 4/2006 | Peterson et al. |
| 2006/0130238 | A1 | 6/2006 | Smith |
| 2006/0130239 | A1 | 6/2006 | Smith |
| 2006/0168727 | A1 | 8/2006 | Heimbrock |
| 2007/0151032 | A1 | 7/2007 | Heavrin |
| 2009/0007332 | A1 | 1/2009 | Wu et al. |
| 2009/0199339 | A1 | 8/2009 | Barr |
| 2009/0229049 | A1 | 9/2009 | Heimbrock et al. |
| 2010/0000016 | A1 | 1/2010 | Aiken et al. |
| 2010/0242176 | A1 | 9/2010 | Newkirk et al. |
| 2011/0185507 | A1 | 8/2011 | Abernathey et al. |
| 2011/0191957 | A1 | 8/2011 | Hornbach et al. |
| 2012/0124746 | A1 * | 5/2012 | Andrienko et al. ..... 5/618 |
| 2012/0144583 | A1 | 6/2012 | Turner |
| 2012/0144587 | A1 | 6/2012 | Andrienko |

FOREIGN PATENT DOCUMENTS

| | | | |
|---|---|---|---|
| WO | WO 82/02832 | | 9/1982 |
| WO | WO 01/47340 | A2 | 7/2001 |
| WO | WO 03/015686 | A1 | 2/2003 |
| WO | WO 03/032777 | A1 | 4/2003 |
| WO | WO 2006/025245 | A1 | 3/2006 |
| WO | WO 2006/058506 | | 6/2006 |

* cited by examiner

SIDERAIL ASSEMBLY FOR PATIENT SUPPORT APPARATUS

CROSS-REFERENCE TO RELATED APPLICATIONS

This application is a continuation of U.S. application Ser. No. 12/965,953, which was filed Dec. 13, 2010, now U.S. Pat. No. 8,621,688, and which is hereby incorporated by reference herein.

BACKGROUND

The present disclosure is related to a support apparatus for supporting a patient. More particularly, the present disclosure relates to a bed that can be manipulated to achieve both a conventional bed position having a horizontal support surface and a chair position having the feet of the patient on or adjacent to the floor and the head and back of the patient supported above a seat formed by the bed.

It is known to provide beds that have a headrail assembly coupled to a head portion of the support surface and a siderail assembly coupled along a seat portion of the support surface. The siderail assemblies may be movable independently of one another between a raised position and a lowered position. The siderail assemblies may be used in the raised position to retain patients resting on the support surface and in the lowered position to transfer patients from the bed to another support apparatus, allow a caregiver improved access to the patient, or to help with entering and exiting the bed.

It is also known that patients egress from a side of the bed. Before the patient is able to egress, the patient must rotate the patient's body on the support surface to face toward the side, swing the patient's legs over the side of the bed, and remain sitting in an upright position without support from the support surface to the patient's back. Such coordinated movement to egress from the side of the bed may be difficult for some patients. As a result, egress from the chair position of the bed may be more suitable to some patients. With the bed in the chair position, the patient begins with the patient's feet resting on the floor, the patient sitting in the upright position, and the patient's back being supported by the support surface. To egress from the bed, the patient supports a portion of the patient's weight on the support surface on each side of the patient or on a caregiver standing next to the bed. The patient then leans forward and transfers the remaining weight to the patient's feet.

SUMMARY

This application discloses one or more of the features recited in the appended claims and/or the following features which, alone or in any combination, may comprise patentable subject matter.

In one aspect of the present disclosure, a patient support apparatus includes a base, a frame coupled to the base, the frame being movable relative to the base, a deck supported by the frame and movable relative to the frame between a horizontal position and an articulated position, and a siderail assembly. The deck includes at least a head section, a foot section spaced-apart from the head section, and a seat section positioned between the head section and the foot section. The foot section is pivotable about a first lateral pivot axis relative to the frame. The siderail assembly includes a guide, a support, a barrier, and a pivot unit. The guide is coupled to the frame of the patient support apparatus. The support is coupled to the guide to move relative to the guide. The barrier includes a lower panel coupled to the support to move therewith and an upper panel coupled to the lower panel to extend in an upward direction away from the lower panel. The barrier is movable about a generally longitudinal axis between a raised position wherein the upper panel is positioned to lie above the deck and a lowered position wherein the lower panel is positioned to lie below the deck while the barrier remains in a generally vertical orientation. The pivot unit is arranged to interconnect the upper panel to the lower panel to cause the upper panel to rotate about a generally vertical axis from a straight position wherein the upper panel is generally aligned vertically with the lower panel and positioned to lie outside of a seat-section space defined to be above the seat section and by a perimeter of the seat section and a canted position wherein the upper panel has rotated toward the seat section of the deck to cause the upper panel to extend into the seat-section space so that an angle is defined between the upper panel and the lower panel.

In some embodiments, the pivot unit may include a pivot that defines the vertical axis and is arranged to lie between and to interconnect the lower panel and the upper panel. The upper panel may include a foot end and an opposite head spaced-apart from the foot end and the pivot may be positioned to lie between the head end and the foot end. The pivot may be positioned to lie about midway between the head end and the foot end. Further, the upper panel may be formed to include an aperture at the foot end of the upper panel. The aperture may be adapted to receive a hand of a patient therein.

It is contemplated that the seat section of the deck may include a first longitudinal side, a second longitudinal side spaced-apart from and generally parallel to the first longitudinal side, a head end extending between and interconnecting the first and second longitudinal sides, and a foot end spaced-apart from and generally parallel to the head end. In such embodiments, the guide may be coupled to the frame to cause the barrier to extend along the first longitudinal side of the seat section when the upper panel is in the straight position.

The patient support apparatus may further include a second siderail assembly including a guide, a support coupled to the guide to move relative to the guide, and a barrier including a lower panel coupled to the support to move therewith and an upper panel coupled to the lower panel to extend in the upward direction away from the lower panel. The upper panel may be movable about a second vertical axis between a straight position and a canted position. In such embodiments, a first distance may be defined between a foot end of the upper panel of the siderail assembly and a foot end of the upper panel of the second siderail assembly when the upper panels are in the straight position. A second distance may also be defined between the foot ends of the upper panels when the upper panels are in the canted positions. The first distance may be greater than the second distance.

In another aspect of the present disclosure, a patient support apparatus includes a base, a frame coupled to the base the frame being movable relative to the base, a deck supported by the frame and movable relative to the frame between a horizontal position and an articulated position, and a siderail assembly. The deck includes at least a head section, a foot section spaced-apart from the head section, and a seat section positioned between the head section and the foot section. The foot section being pivotable about a first lateral pivot axis relative to the frame. The siderail assembly includes a guide, a support coupled to the guide to move relative to the guide, a barrier including a foot end and an opposite head end spaced-apart from the foot end, and a pivot unit. The barrier is coupled to the support to move about a generally longitudinal axis between a raised position wherein the upper panel is positioned to lie above the deck and a lowered position wherein the lower panel is positioned to lie below the deck while the barrier remains in a generally vertical orientation. The pivot unit includes a carrier foundation, a guide, and a pivot. The carrier foundation is coupled to the frame in a fixed position relative to the frame. The guide carrier is coupled to the guide to cause the guide, the support, and the barrier to move therewith. The pivot is arranged to interconnect the guide carrier and the carrier foundation to cause the guide carrier to move about a vertical axis relative to the carrier foundation between a straight position wherein the barrier is spaced-apart laterally from the deck and a canted position wherein the barrier has rotated about the vertical axis in a first direction toward the deck to cause the barrier to extend toward the deck.

In some embodiments, the guide carrier may include a bracket coupled to the frame and a flange. The flange may extend away from the frame. In some such embodiments, the guide carrier may include an axle extending along the vertical axis and the flange is formed to include an axle receiver sized to receive the axle for movement of the axle relative thereto.

It is contemplated that the upper panel and the lower panel may be monolithically formed. The upper panel may include an aperture forming a handle at the foot end of the barrier.

The pivot may be situated between the head end and the foot end of the barrier. The pivot may further be situated below the frame. The vertical location of the pivot may be maintained when the barrier moves between the raised position and the lowered position.

In another aspect of the present disclosure, a patient support apparatus includes a base, a frame coupled to the base, a deck, a first siderail assembly, and a second siderail assembly. The frame is movable relative to the base. The deck is supported by the frame and movable relative to the frame between a horizontal position and an articulated position. The deck includes at least a head section, a foot section spaced-apart from the head section, and a seat section positioned between the head section and the foot section. The foot section is pivotable about a first lateral pivot axis relative to the frame. The seat section includes a top surface arranged to face in an upward direction, an opposite bottom surface, a first longitudinal side extending between the top and bottom surfaces, and a second longitudinal side space-apart from and generally parallel to the first longitudinal side. The first siderail assembly is coupled to the frame along the second longitudinal side of the seat section. The first siderail assembly includes a foot end and an opposite head end spaced-apart from the foot end. The second siderail assembly includes a guide, a support, a barrier, and a pivot unit. The guide is coupled to the frame of a patient support apparatus along the first longitudinal side of the seat section. The support is coupled to the guide to move relative to the guide. The barrier includes a lower panel coupled to the support to move therewith and an upper panel coupled to the lower panel to extend in the upward direction away from the lower panel. The upper panel includes a foot end and an opposite head end spaced-apart from the foot end. The barrier is movable about a generally longitudinal axis between a raised position wherein the upper panel is positioned to lie above the deck and a lowered position wherein the lower panel is positioned to lie below the deck. The barrier remains in a generally vertical orientation during movement between the lowered and the raised positions. The pivot unit is configured to move the upper panel of the barrier about a vertical axis relative to the seat section between an aligned position and a canted position, In the aligned position, the upper panel is spaced-apart laterally from the seat section to cause a first distanced to be defined between the foot end of the first siderail assembly and the foot end of the upper panel. In the canted position, the upper panel has moved about the vertical axis toward the seat section to cause a second distance to be defined between the foot end of the first siderail assembly and the foot end of the upper panel. The first distance is greater than the second distance.

It is contemplated that the pivot unit may interconnect the upper panel to the lower panel to cause the upper panel to rotate about a generally vertical axis when the upper panel moves between the aligned position and the canted position. The pivot unit may include an axle, the axle being a hollow tubular member.

In some embodiments, the upper panel and the lower panel may be monolithic and the lower panel may move with the lower panel. In such embodiments, the support may be coupled to the lower panel for pivotable movement about the generally vertical axis with the lower panel.

In some embodiments, the pivot unit is further configured to move the upper panel to an extended position. When the upper panel is in the extended position, the upper panel may be arranged lie in generally perpendicular relation with the lower panel.

Additional features alone or in combination with any other feature(s), including those listed above, those listed in the claims, and those described in detail below, may comprise patentable subject matter. Other features will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
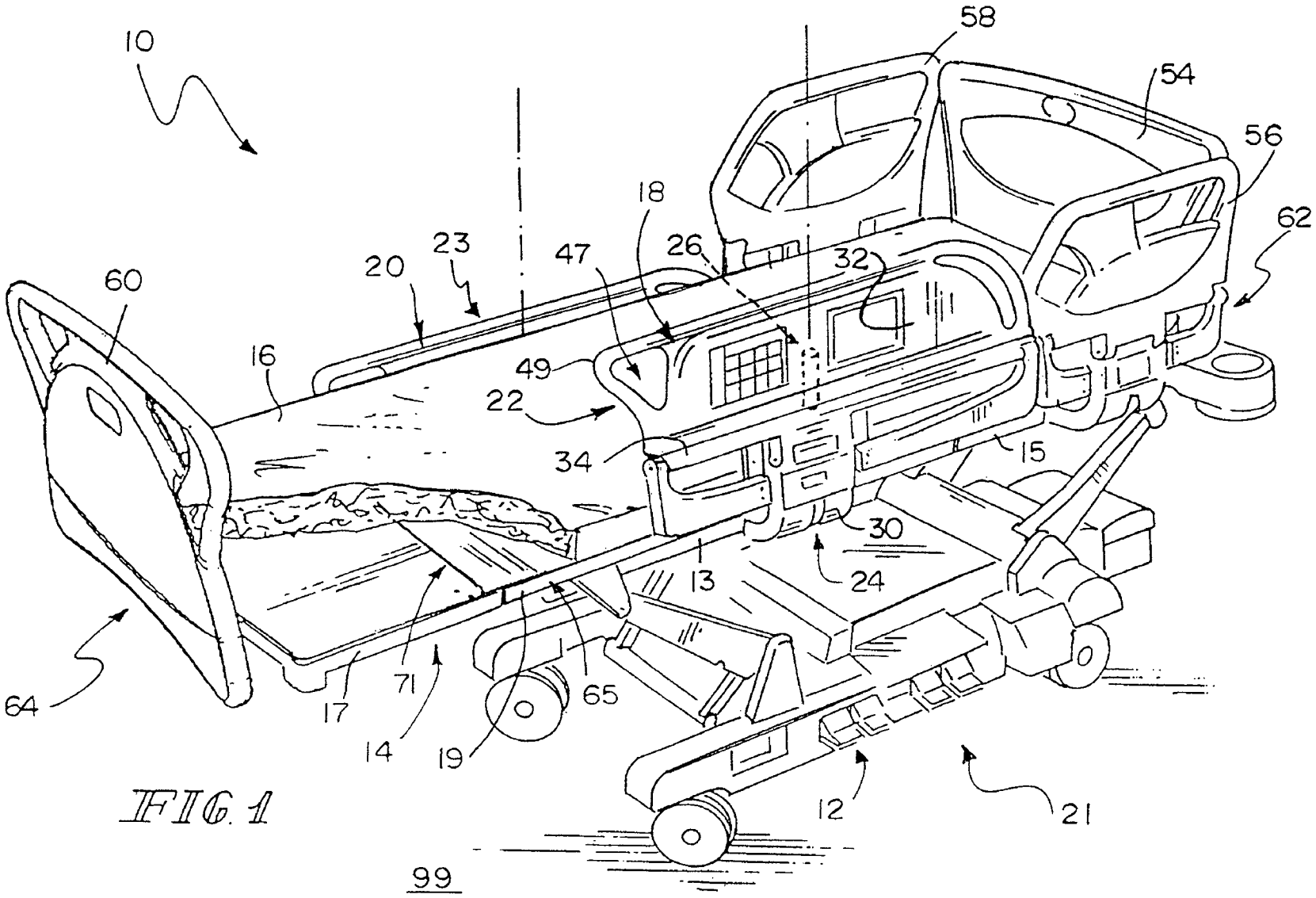
FIG. 1 is a perspective view of a patient support apparatus including a siderail in a raised position and another siderail in a lowered position.
Figure 2:
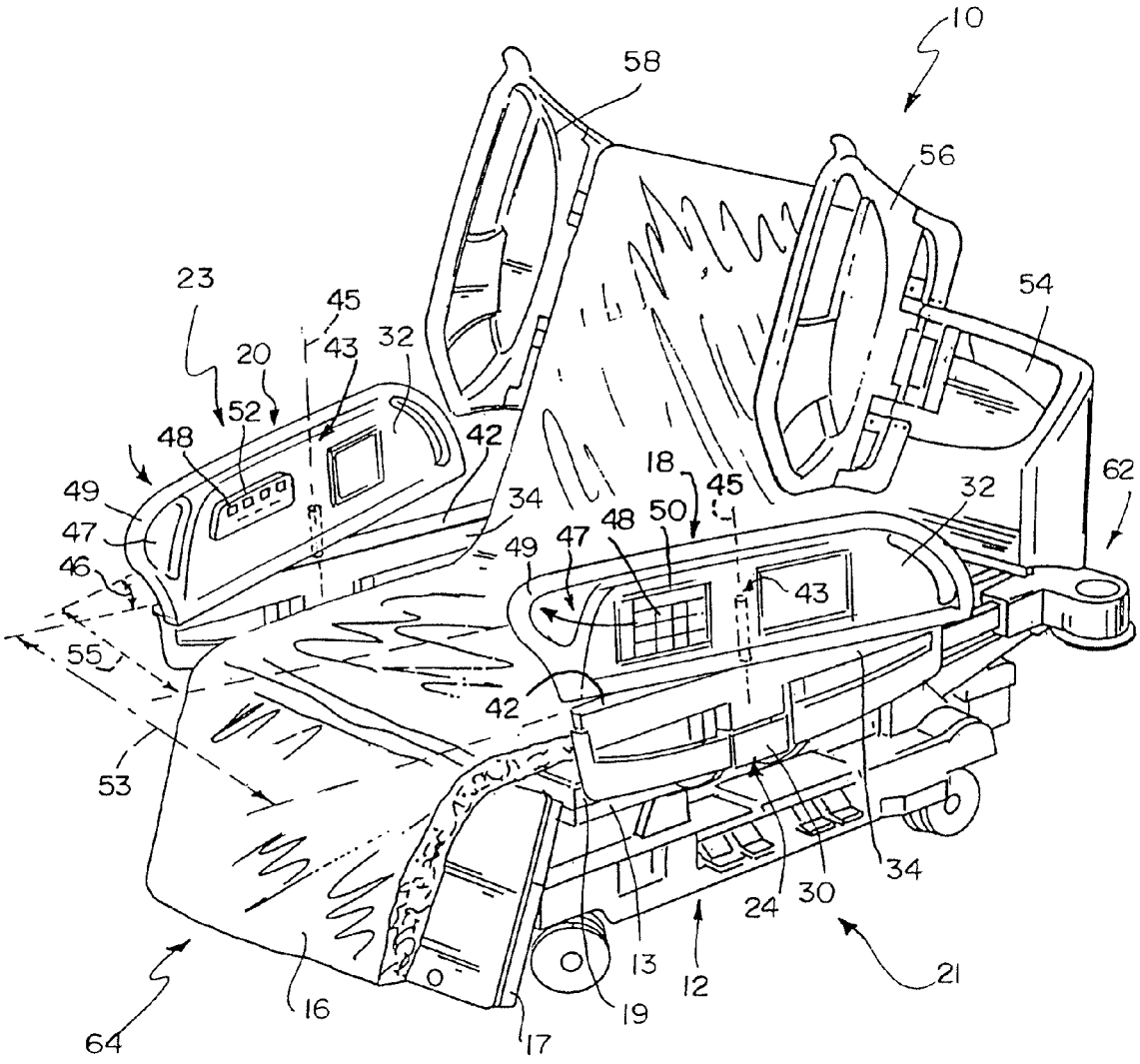
FIG. 2 is a view similar to FIG. 1 with each siderail in a canted position.

A patient support apparatus illustratively embodied as a hospital bed 10 comprises a base 12, a frame 13, a deck 14, and a mattress 16 as shown in FIG. 1. The deck 14 is supported by the base 12 and is articulatable relative to the frame 13. The deck 14 supports the mattress 16. The bed 10 is movable between a horizontal bed position, in which the deck 14 is generally flat as shown in FIG. 1, and a chair egress position as shown in FIG. 2, in which the deck 14 is articulated so that the bed 10 is configured to allow a patient to egress or exit the bed 10 from a sitting position.

The deck 14 includes a head section 15, a foot section 17, and a seat section 19 situated between the head section 15 and the foot section 17. The head section 15 is pivotably coupled to the seat section 19. Additionally, the foot section 17 is pivotably coupled to the seat section 19. The foot section 17 is also extendable and retractable so that the foot end 64 of the foot section 17 moves between an extended position and a retracted position relative to the seat section 19.

The bed 10 further includes a first or left siderail assembly 18 and a second or right siderail assembly 20. The left and the right siderail assemblies 18, 20, sometimes referred to as siderails 18, 20 are substantially similar and further discussion herein of the left siderail 18 is thus equally applicable to the right siderail 20. The left siderail 18 is coupled to the frame 13 and extends along a first or left side 21 of the bed 10. The right siderail 20 is coupled to the frame 13 along a second or right side 23 of the bed 10.

The siderail 18 includes a barrier member 22, a linkage 24, and a pivot unit 26 as shown in FIGS. 1-5. The linkage 24 includes a guide 28 and a support 30. The guide 28 is coupled to the frame 13. The support 30 is coupled to the guide 28 by pins 51*a* and 51*b* and to the barrier member 22. The support 30 is situated between the guide 28 and the barrier member 22 and cooperates with the support 30 to form the linkage 24. The linkage 24 is operable to move the barrier member 22 between a raised position, as illustrated by the left siderail 18 in FIG. 1, and a lowered position, as illustrated by the right siderail 20 in FIG. 1. The barrier member 22 remains in a generally vertical orientation in both the raised and lowered positions during movement between the raised and the lowered positions.

The barrier member 22 includes an upper panel 32 and a lower panel 34. The upper panel 32 extends above the lower panel 34. The upper panel 32 is formed to include an aperture 47 that defines a handle 49 at a foot end of the upper panel 32 as shown in FIGS. 1-5. The support 30 is coupled to the lower panel 34 of the barrier member 22. When the barrier member 22 is in the raised position, the upper panel 32 and at least a portion of the lower panel 34 extends above the frame 13 and the deck 14. When the barrier member 22 is in the lowered position, the lower panel 34 and at least a portion of the upper panel 32 extend below the frame 13 and the deck 14.

Figure 3:
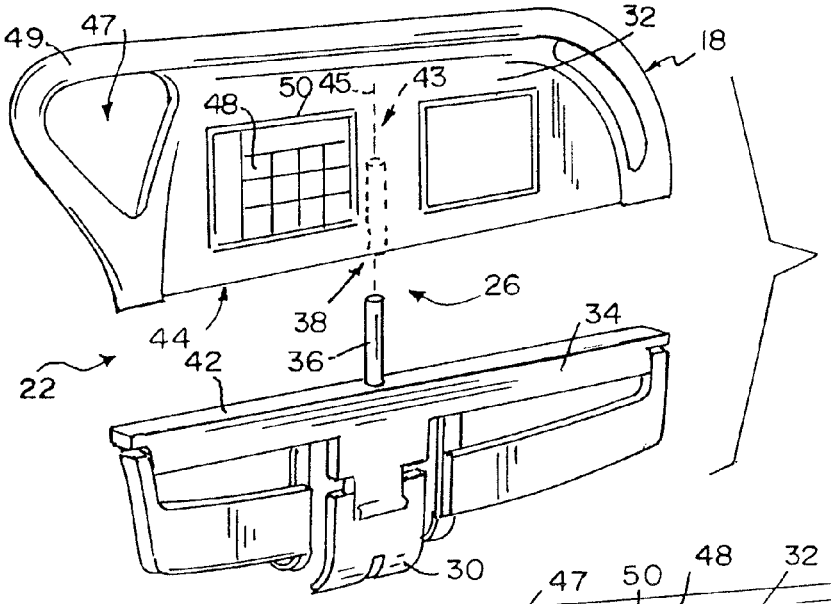
FIG. 3 is an exploded perspective assembly view of the left siderail of FIGS. 2 and 3.
Figure 4:
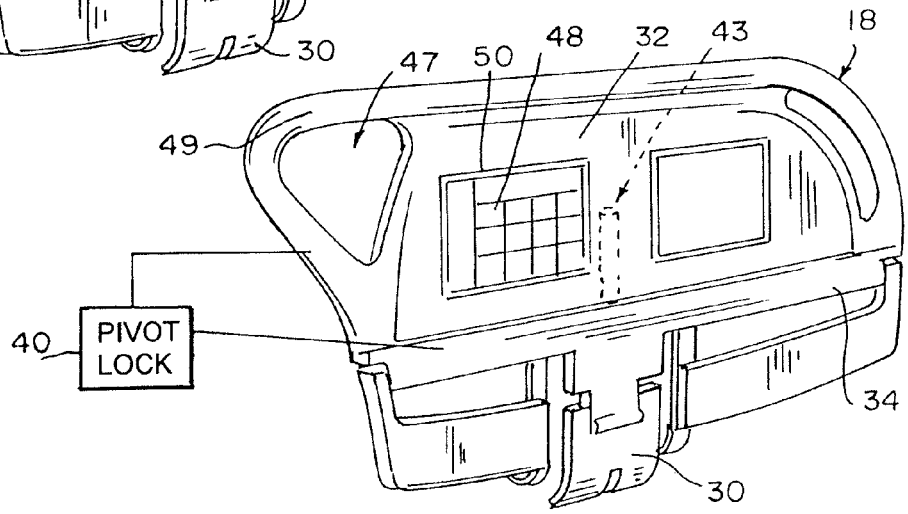
FIG. 4 is a perspective view and a diagrammatic view of the left siderail of FIGS. 1 and 2 in the raised position.
Figure 5:
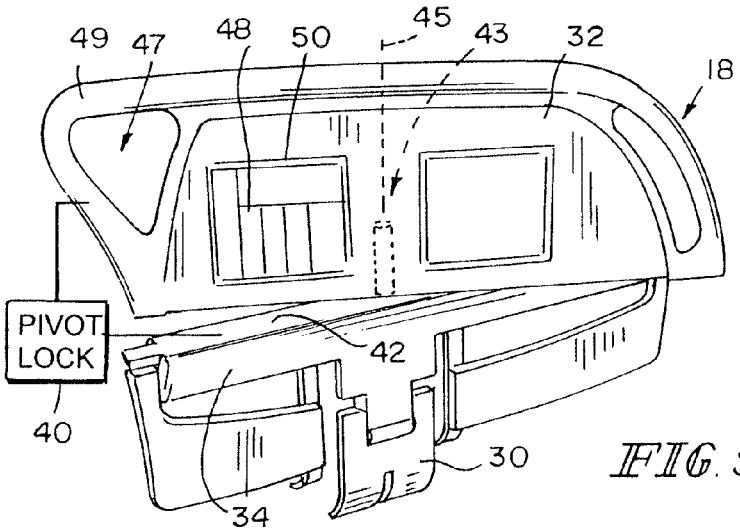
FIG. 5 is a view similar to FIG. 4 with the left siderail in the canted position.

The pivot unit 26 of the siderail 18 includes an axle 36, an axle receiver 38, and a pivot lock 40 as shown in FIGS. 3-5. The axle 36 extends upwardly from a top surface 42 of the lower panel 34 of the barrier member 22 as shown in FIG. 3. In some embodiments, the axle 36 is a hollow tube allowing wiring to be passed through the axle 36. The axle receiver 38 is an aperture sized to receive the axle 36. Further, the axle receiver 38 is formed in the upper panel 32 of the barrier member 22 and opens in a bottom surface 44 upwardly in the upper panel 32. The axle 36 and the axle receiver 38 cooperate to form a pivot 43 located about midway along the barrier member 22 and define an axis 45 about which the upper panel 32 pivots relative to the lower panel 34.

Figure 2A:
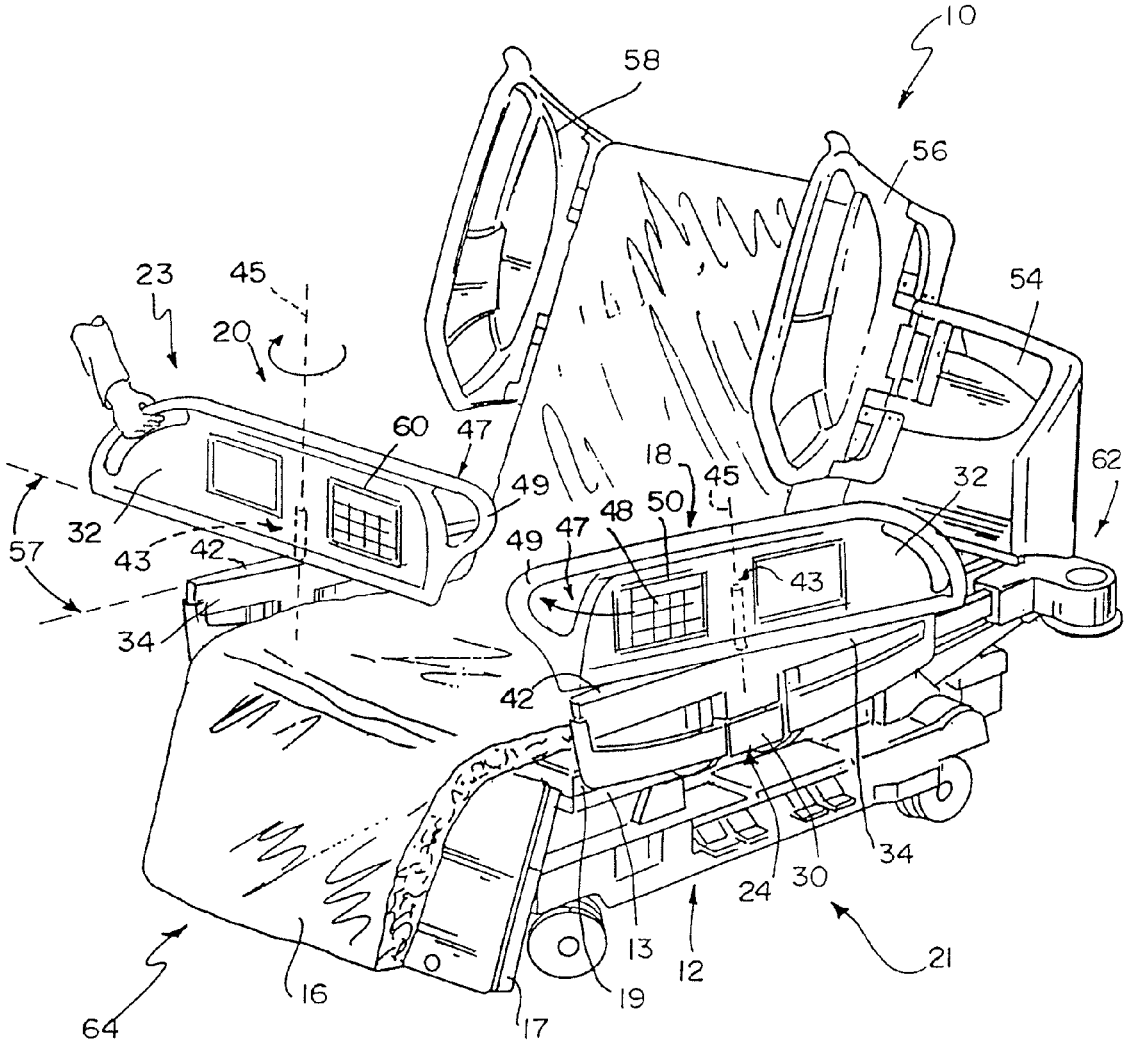
FIG. 2A is a view similar to FIGS. 1 and 2 with the right siderail in an extended position.

The upper panel 32 is movable between a straight position, as shown in FIG. 1, a canted position, as shown in FIG. 2, and an extended position as shown in FIG. 2A. In the straight position, the upper panel 32 is generally vertically aligned with the lower panel 34. Also, while in the straight position, the upper panel 32 is spaced-apart laterally from the deck 14 and is situated outside of a seat-section space defined above the seat section 19 of the deck 14. Further, while in the straight position, a foot end of the left siderail 18 is spaced a first distance 53 from a foot end of the right siderail 20 as shown in FIG. 2. In the canted position, the upper panel 32 forms a first angle 46 with the lower panel 34. As an example, the first angle is an acute angle. Also, while in the canted position, the upper panel 32 extends toward the deck 14 and is situated inside of a seat section space defined above the seat section 19 of the deck 14. Further, when in the canted position, the left siderail 18 is spaced a second distance 55 from the foot end of the right siderail 20 as shown in FIG. 2. In the extended position, the upper panel 32 of right siderail 20 forms a second angle 57 with the lower panel 34 which is about 90 degrees. The upper panel 32 while in the extended position is perpendicular to the lower panel 34 and extends away from the hospital bed 10 as shown in FIG. 2A.

In the illustrative embodiment, the upper panel 32 is moved to the straight position when the bed 10 is in the horizontal bed position and to the canted position and the extended position when the bed 10 is in the chair egress position, as shown in FIGS. 1 and 2, by a caregiver. In other embodiments, the movement of the upper panel 32 may be automated by an electric motor, a servo, or a pneumatic driver. Thus, when the upper panel 32 is moved from the straight position to the canted position or extended position, the upper panel 32 provides a surface for a patient to use as a support. When the upper panel 32 is in the canted position, the upper panel provides a surface for a patient sitting on the bed 10 to use as a support when pushing up and off of the bed 10 in the chair egress position. When the upper panel 32 is in the extended position, the upper panel provides a surface for a patient undergoing therapy. As an example, the patient may use the upper panel 32 in the extended position as a support during walking therapy.

In some embodiments, the siderail 18 includes a position sensor configured to detect whether the upper panel 32 is in the straight or canted position. In embodiments with a position sensor, movement of the deck 14 may be blocked when the upper panel 32 is in the canted position to minimize contact between the upper panel 32 and other portions of the bed 10.

The pivot lock 40 is configured to move between a locked position and an unlocked position. In the locked position, the pivot lock 40 blocks movement of the upper panel 32 relative to the lower panel 34. In the illustrative embodiment, the pivot lock 40 may be configured to automatically move from the unlocked position to the locked position when the upper panel 32 is in the straight, the canted, or the extended position. In such embodiments, a caregiver or a patient may move the pivot lock 40 to the unlocked position when it is desirable to move the upper panel 32 relative to the lower panel 34. In other embodiments, the pivot lock 40 may be moved between the locked and the unlocked position by a caregiver or a patient. A caregiver or a patient may move the pivot lock 40 between both the locked and unlocked positions by actuating an icon 48 on an outer control panel 50 or an inner control panel 52 coupled to the siderail 18. In some embodiments, the upper panel 32 may be locked at intermediate positions between the straight, the canted, and the extended positions by the pivot lock 40.

The bed 10 further includes a headboard 54, a first or left head siderail 56, a second or right head siderail 58, and a footboard 60. The headboard 54 is removably coupled to the frame 13 and extends along a head end 62 of the bed 10. The left and the right head siderails 56, 58 are coupled to head section 15 for movement therewith along the left and the right sides 21, 23 of the bed 10, respectively. The footboard 60 is removably coupled to the foot section 17 of the deck 14 for movement therewith and extends along a foot end 64 of the bed 10.

The seat section 19 has a first or left side 65, a second or right side (not shown), a head end (not shown), and a foot end 71. The left side 65 extends along the left side 21 of the bed 10. The right side is spaced apart from the left side 65 and is generally parallel to the left side 65. The head end extends between the left side 65 and the right side. The foot end 71 also extends between the left side 65 and the right side and is spaced apart from and generally parallel to the head end. The guide 28 is coupled to the frame 13 to cause the barrier to extend along the left side 65 of the seat section 19 when the upper panel 32 is in the straight position.

Figure 6:
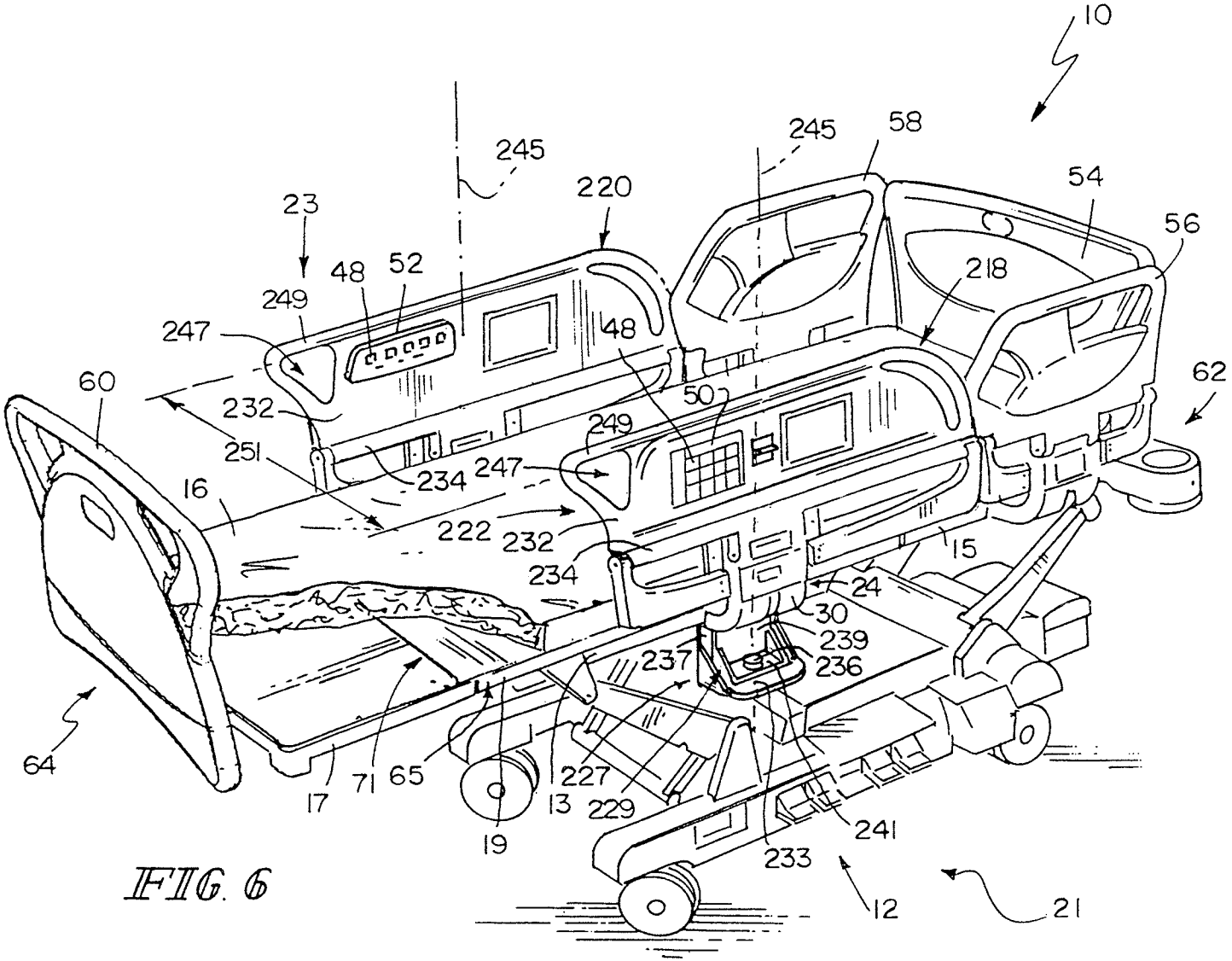
FIG. 6 is a perspective view of another embodiment of a patient support apparatus including two head siderails in the raised position and two foot siderails in the raised position.
Figure 7:
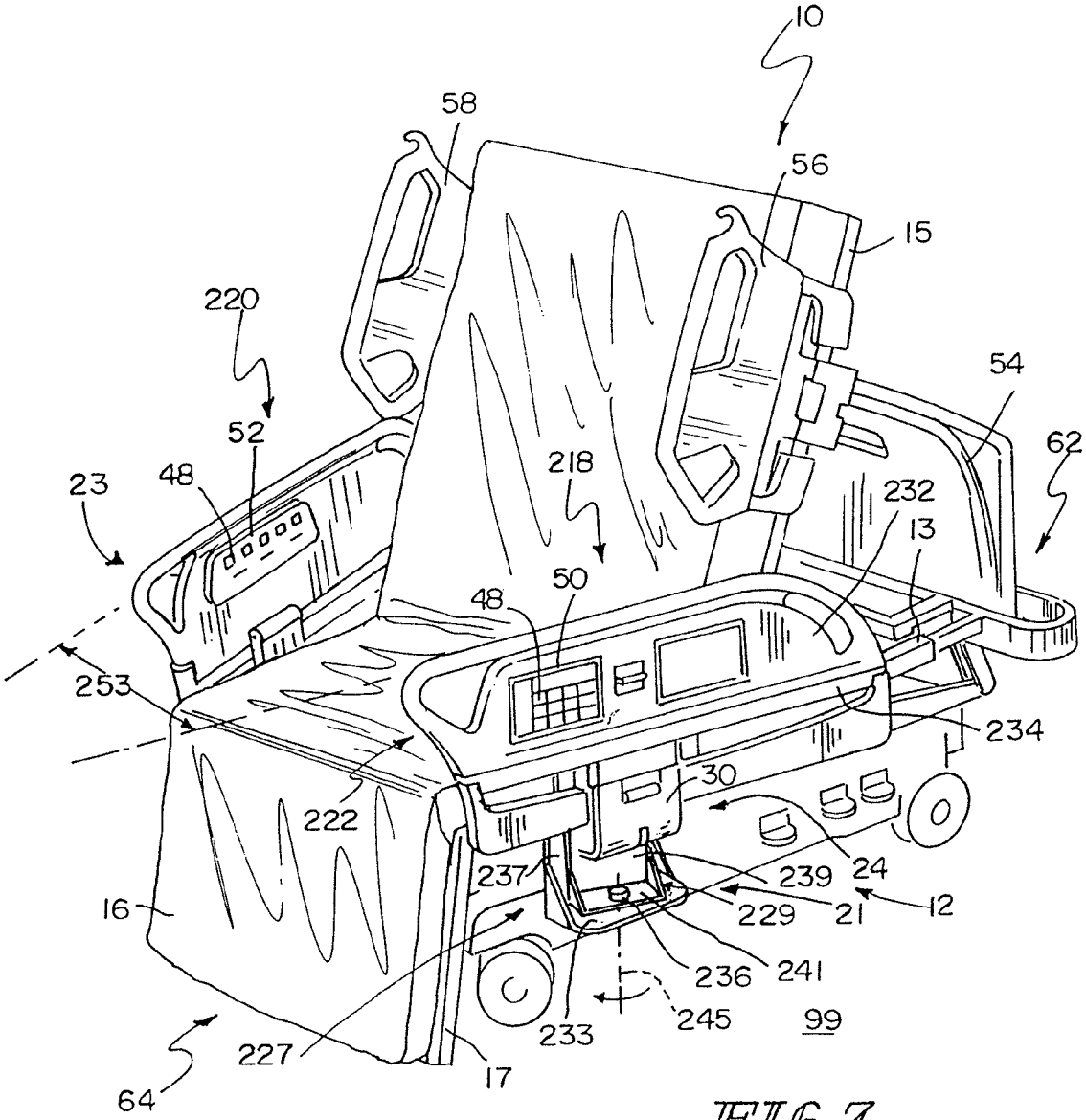
FIG. 7 is a view similar to FIG. 6 with each siderail in the canted position.
Figure 8:
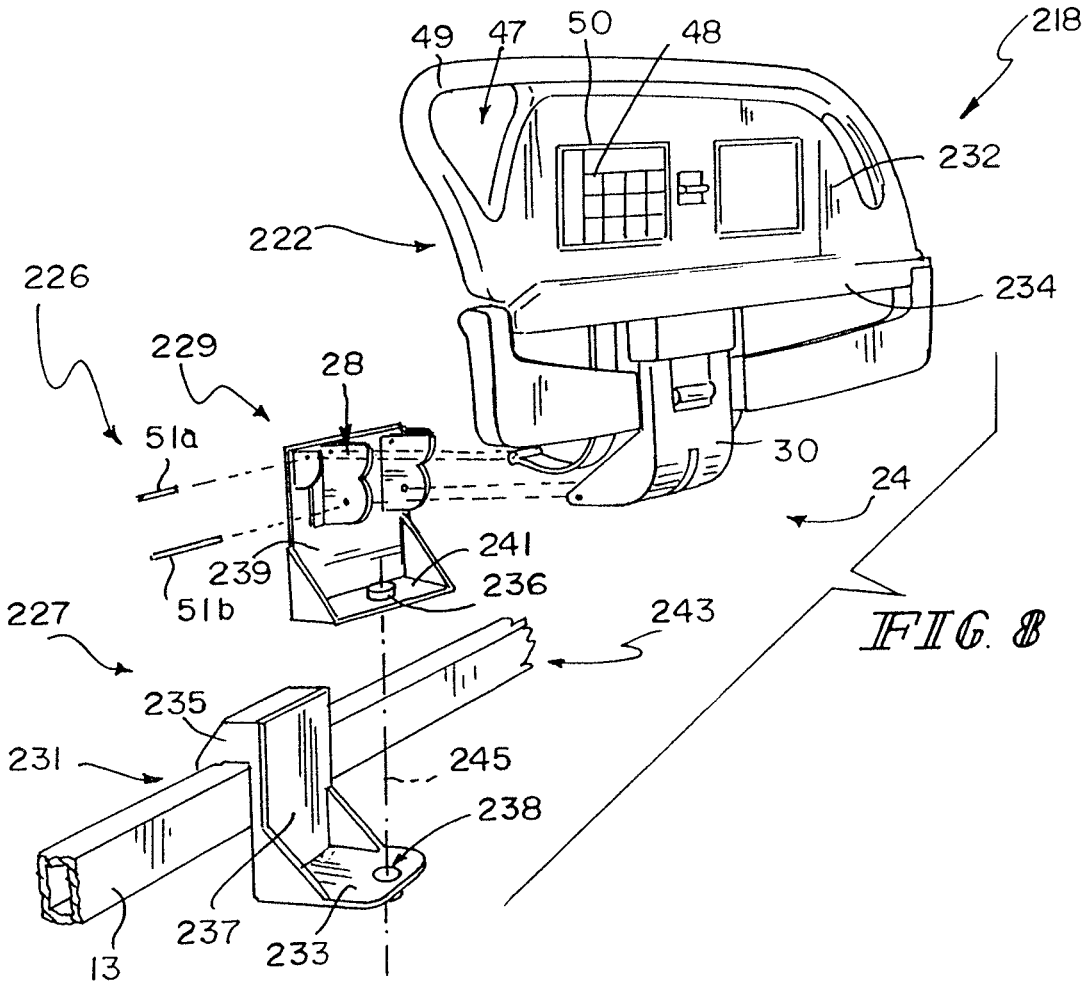
FIG. 8 is an exploded perspective assembly view of the siderail of FIGS. 6 and 7.
Figure 9:
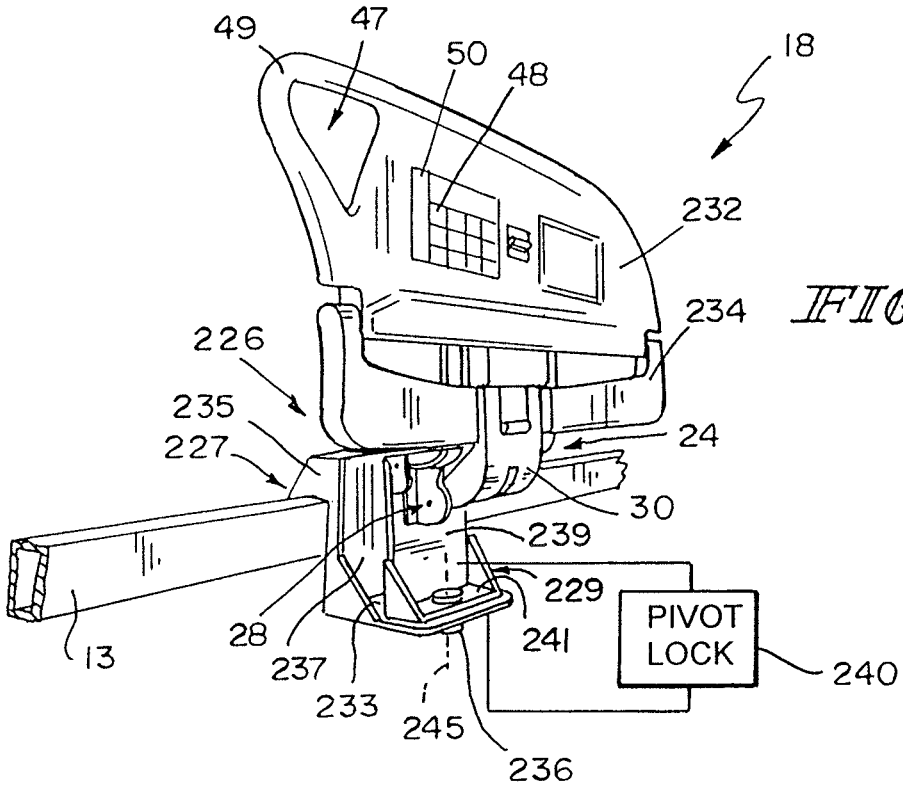
FIG. 9 is a perspective view and a diagrammatic view of the siderail of FIGS. 6 and 7 in the raised position.
Figure 10:
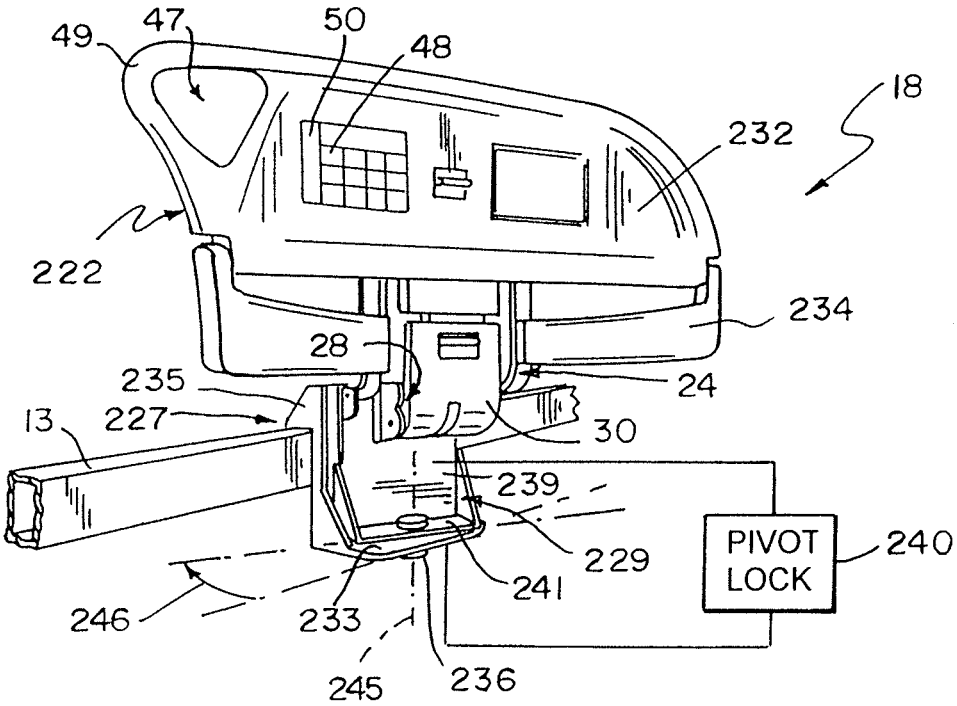
FIG. 10 is a view similar to FIG. 9 with the siderail in the canted position.

Another illustrative bed 210 is shown in FIGS. 6-10 with other embodiments of left and right siderail assemblies 218, 220 (hereinafter referenced as a siderail 218). The siderail 218 includes a barrier member 222, a linkage 24, and a pivot unit 226 as shown in FIGS. 8-10. The pivot unit 226 includes a foundation carrier 227 and a guide carrier 229. The foundation carrier 227 includes a bracket 231 and a flange 233. The bracket 231 has an arm 235 coupled to the frame 13 and a plate 237 extending downwardly from the arm 235 below the frame 13. The flange 223 extends away from the bottom of the plate 237 toward the left side 21 of the bed 210. The flange 223 is also formed to include an axle receiver 238.

The guide carrier 229 includes the guide 28, a carrier plate 239, and a carrier flange 241 as shown in FIGS. 6-10. The guide 28 is coupled to and extends away from the carrier plate 239 toward the left side 21 of the bed 210. The carrier flange 241 is coupled to the carrier plate 239 below the guide 28 and extends away from the carrier plate 339 toward the left side 21 of the bed 210. The carrier flange 241 includes an axle 236 spaced-apart from the carrier plate 239 and the axle 236 extends downwardly toward the floor 99 from the carrier flange 241. In some embodiments, the axle 236 is a hollow tube to allow wiring to be passed through the axle 236. The axle 236 and the axle receiver 238 cooperate to form a pivot 243 located about midway along the barrier member 222 and define a pivot axis 245.

The linkage 24 includes the guide 28 and the support 30 as shown in FIGS. 8-10. The support 30 is coupled to the guide by pins 51*a* and 51*b* and to the barrier member 222. The support 30 is situated between the guide 28 and the barrier member 222 and cooperates with the guide 28 to form the linkage 24. The linkage 24 is operable to move the barrier member 222 between the raised position and the lowered position. The barrier member 222 remains in a generally vertical orientation in both the raised and lowered positions and during movement between the raised and the lowered positions.

The barrier member 222 includes an upper panel 232 and a lower panel 234. The upper panel 232 is appended to the lower panel 234. The support 30 is coupled to the lower panel 234 of the barrier member 222. The upper panel 232 extends above the lower panel 234 and is formed to include an aperture 247 that defines a handle 249 at the foot end of the upper panel 232. When the barrier member 222 is in the raised position, the upper panel 232 and at least a portion of the lower panel 234 extends above the frame 13 and the deck 14. When the barrier member 222 is in the lowered position, the lower panel 234 and at least a portion of the upper panel 232 extend below the frame 13 and the deck 14.

The barrier member 222 and the linkage 24 are movable relative to the foundation carrier 227 and the frame 13 between a straight position, as shown in FIG. 6, and a canted position, as shown in FIG. 7. In the straight position, barrier member 222 is generally aligned with the frame 13 along the left side 21 of the bed 210. Also, while in the straight position, the barrier member 222 is spaced-apart laterally from the deck 14. Further, while in the straight position, a foot end of the left siderail 218 is spaced a first distance 251 from a foot end of the right siderail 220 as shown in FIG. 6. In the canted position, the barrier member 222 forms an angle 246 with the frame 13 along the left side 21 of the deck 14. Also, while in the canted position, the barrier member 222 extends toward the deck 14. Further, when in the canted position, the left siderail 218 is spaced a second distance 253 from the foot end of the right siderail 220 as shown in FIG. 7. In the illustrative embodiment, the first distance 251 is greater than the second distance 253.

In the illustrative embodiment, the barrier member 222 and the linkage 24 are moved to the straight position when the bed 210 is in the horizontal bed position and to the canted position when the bed 210 is in the chair egress position, as shown in FIGS. 6 and 7, by a caregiver. In other embodiments, movement of the barrier member 222 and the linkage 24 may be automated by an electric motor, a servo, or a pneumatic driver. Thus, when the barrier member 222 and the linkage 24 are moved to the canted position, the upper panel 232 provides a surface for a patient sitting on the bed 210 to use as a support when pushing up and off of the bed 210 in the chair egress position. In some embodiments, the siderail 218 includes a position sensor configured to detect whether the barrier member 222 and the linkage 24 are in the straight or the canted position. In embodiments with a position sensor, movement of the deck 14 may be blocked when the barrier member 222 and the linkage 24 are in the canted position to minimize contact between the barrier member 222 and other portions of the bed 210.

The pivot lock 240 is configured to move between a locked position and an unlocked position as shown diagrammatically in FIGS. 9 and 10. In the locked position, the pivot lock 240 blocks movement of the barrier member 222 and the linkage 24 relative to the foundation carrier 227. In the illustrative embodiment, the pivot lock 240 may be configured to automatically move from the unlocked to the locked position when the barrier member 222 is in the straight or the canted position. In such embodiments, a caregiver or a patient may move the pivot lock 240 to the unlocked position when it is desirable to move the barrier member 222 relative to the foundation carrier 227. In other embodiments, the pivot lock 240 may be moved between both the locked and the unlocked position by a caregiver or a patient. A caregiver or a patient may cause the pivot lock 240 to move between the locked and unlocked positions by engaging the icon 48 on the outer control panel 50 or the inner control panel 52 coupled to the siderail 218.

The illustrative hospital beds 10 and 210 are a so-called chair bed, in that it is movable between a horizontal bed position, as shown in FIGS. 1 and 6, and a chair-egress position as shown in FIGS. 2 and 7. However the teachings of this disclosure are applicable to all types of hospital beds, including those that are incapable of achieving a chair-egress position. Some hospital beds are only able to move into a chair-like position, sometimes referred to by those in the art as a "cardiac chair position," and this disclosure is equally applicable to those types of beds. Furthermore, the teachings of this disclosure are applicable to other types of patient support apparatuses such as stretchers, motorized chairs, operating room (OR) tables, specialty surgical tables such as orthopedic surgery tables, examination tables, and the like.

Although certain illustrative embodiments have been described in detail above, variations and modifications exist within the scope and spirit of this disclosure as described and as defined in the following claims.

The invention claimed is:

1. A patient support apparatus comprising a frame, and a siderail assembly coupled to the frame and including a barrier including a lower panel and an upper panel above the lower panel, the barrier being movable relative to the frame between a raised position and a lowered position while remaining in a generally vertical orientation, the upper panel being pivotable relative to the lower panel about a generally vertical axis between a straight position generally aligned vertically with the lower panel and a canted position having the upper panel extending over and across the lower panel so that an angle is defined between the upper panel and the lower panel with a first portion of the upper panel being situated on one side of the lower panel and extending away from the lower panel and toward the frame and a second portion of the upper panel being situated on an opposite side of the lower panel and extending away from the lower panel and away from the frame.

2. The patient support apparatus of claim 1, further comprising a pivot unit that couples the upper panel to the lower panel for pivoting movement about the generally vertical axis.

3. The patient support apparatus of claim 2, wherein the pivot unit includes a pivot post that defines the generally vertical axis.

4. The patient support apparatus of claim 2, wherein the upper panel includes a foot end and an opposite head end spaced-apart from the foot end and the pivot unit is positioned about midway between the head end and the foot end so that the generally vertical axis is positioned about midway between the head end and the foot end.

5. The patient support apparatus of claim 1, wherein the frame is movable between a first position to support a patient in supine position and a second position to support the patient in a sitting position, the foot end of the upper panel includes a hand grip that is used by the patient to assist the patient in standing up from the frame when the frame is in the second position.

6. The patient support apparatus of claim 1, wherein the barrier includes a pivot post that defines the generally vertical axis.

7. The patient support apparatus of claim 6, wherein the pivot post comprises a hollow tube configured to allow pass through of wiring.

8. The patient support apparatus of claim 6, wherein the pivot post extends upwardly from the lower panel and the upper panel is configured to receive the pivot post.

9. The patient support apparatus of claim 1, further comprising a pivot lock movable between a locked and unlocked position, the upper panel being blocked from pivoting about the generally vertical axis relative to the lower panel when the pivot lock is in the locked position, and the upper panel being pivotable about the generally vertical axis relative to the lower panel when the pivot lock is in the unlocked position.

10. The patient support apparatus of claim 9, further comprising a control panel having an icon that is usable to move the pivot lock between the locked and unlocked positions.

11. The patient support apparatus of claim 10, wherein the control panel is carried by the upper panel.

12. The patient support apparatus of claim 1, wherein the upper panel is movable about the generally vertical axis to a perpendicular position oriented at about 90 degrees with respect to the lower panel.

13. The patient support apparatus of claim 12, wherein the frame defines a footprint and a portion of the upper panel overlies a portion of the frame inside the footprint when the upper panel is in the canted position and when the upper panel is in the perpendicular position.

14. The patient support apparatus of claim 13, wherein the upper panel is situated outside the footprint when the upper panel is in the straight position.

15. The patient support apparatus of claim 1, further comprising a mattress supported by the frame, a portion of the upper panel overlying a portion of the mattress when the upper panel is in the canted position, and no portion of the upper panel overlying any portion of the mattress when the upper panel is in the straight position.

16. A patient support apparatus comprising a frame, a siderail assembly coupled to the frame and including a barrier including a lower panel and an upper panel above the lower panel, the barrier being movable relative to the frame between a raised position and a lowered position while remaining in a generally vertical orientation, the upper panel being pivotable relative to the lower panel about a generally vertical axis between a straight position generally aligned vertically with the lower panel and a canted position so that an angle is defined between the upper panel and the lower panel, wherein a first portion of the upper panel extends away from the lower panel and toward the frame and a second portion of the upper panel extends away from the lower panel and away from the frame, and a position sensor and wherein at least one portion of the frame is prevented from moving in response to the position sensor sensing that the upper panel is in the canted position.

* * * * *